United States Patent [19]

Dohi et al.

[11] Patent Number: 5,018,599

[45] Date of Patent: May 28, 1991

[54] HEADPHONE DEVICE

[75] Inventors: Masahiro Dohi; Koji Nageno, both of Tokyo, Japan

[73] Assignee: Sony Corporation, Tokyo, Japan

[21] Appl. No.: 408,569

[22] Filed: Sep. 18, 1989

[30] Foreign Application Priority Data

Oct. 3, 1988 [JP] Japan ..... 63-249407

[51] Int. Cl.[5] ..... H04R 25/00

[52] U.S. Cl. ..... 181/129; 381/187

[58] Field of Search ..... 181/129, 137; 381/153, 381/158, 160, 183, 187

[56] References Cited

U.S. PATENT DOCUMENTS 3,112,005 10/1963 Shaw et al. ..... 181/129

3,596,733 8/1971 Bertagni ..... 381/158

*Primary Examiner*—Brian W. Brown

*Attorney, Agent, or Firm*—Alvin Sinderbrand; William S. Frommer

[57] ABSTRACT

A headphone device includes a pair of housings each attached to a hanger and supporting a loudspeaker unit, and a headband having opposite ends to which the hangers are secured. Each housing includes a front plate to which the loudspeaker unit is attached and a main body portion preferably constructed of natural wood and enclosing the loudspeaker unit with the exception of a front surface of the loudspeaker unit. The inner surface of the main body portion of the housing includes a plurality of irregularities which prevent the generation of standing waves and scatter the housing resonant locations so as to maintain a high quality of reproduced sound.

14 Claims, 5 Drawing Sheets

HEADPHONE DEVICE

BACKGROUND OF THE INVENTION

1. Field of the Invention

The present invention relates to a headphone device in which a loudspeaker unit is held within a housing, which in turn is supported by a supporting member, such as a hanger, at each end of a headband.

2. Description of the Prior Art

In a conventional headphone device adapted to be attached to a user's headband, by means of a resilient head a loudspeaker unit is contained within a housing which is supported at each end of the headband by a loudspeaker supporting member, such as a hanger.

The housing holding the loudspeaker unit is molded from synthetic resins, such as ABS or acrylic resins into a cup-shaped housing having substantially uniform wall thickness. The loudspeaker unit is positioned within the housing so that the sound radiating side of the loudspeaker unit, that is, the side fitted with the side of the loudspeaker unit is also contained within the housing. Upon driving the conventional headphone device, sound waves are radiated from user's auricle, and so that the magnetic circuit on the rear side of the unit will be accommodated within the housing.

In such headphone device having its loudspeaker unit accommodated within the housing, the sound wave radiated from the front surface of the loudspeaker unit towards the user's auricle, and sound waves are radiated from the rear side of the loudspeaker unit to the inside of the housing.

The loudspeaker unit is held within the housing so that the diaphragm is parallel to a smooth flat inner surface of the housing. When the sound waves, radiated from the rear side of the loudspeaker unit are reflected after impinging on the inner surface of the housing, a standing wave is generated. As a result, the sound reproducing properties are lowered and, hence, the reproduced sound heard by the user is also of inferior in quality.

Further, vibrations from the loudspeaker unit are transmitted to the housing which may cause the housing to resonate at a specific frequency. When the housing is constructed with a smooth flat inner surface and uniformed wall thickness, as previously described, the resonant oscillations are typically concentrated at one point. As a result, the sound pressure level at the resonant point is increased significantly thus deteriorating the acoustic properties of the reproduced sound heard by the user. Further, since the resonant oscillations are concentrated at one point of the housing, the housing itself is subjected to mechanical ringing thus, further to deteriorating the accoustic properties of the reproduced sound head by the user.

OBJECTS AND SUMMARY OF THE INVENTION

Accordingly, it is an object of this invention to provide a headphone device which avoids the above-mentioned disadvantages of the prior art.

More specifically, it is an object of the present invention to provide a headphone device which is capable of suppressing the generation of a standing wave.

It is another object of the present invention to provide a headphone device in which resonant oscillations are scattered throughout the housing so as to prevent resonances from occurring at one point of the housing which lower the sound reproducing properties.

It is still another object of the present invention to provide a headphone device in which the loudspeaker unit is contained within a housing constructed from a piece of pure natural wood, which is a preferred housing material because of its relatively high Young's modulus and relatively high internal losses.

According to an aspect of the present invention, a headphone device comprises: a loudspeaker unit including a diaphragm having a front surface and a magnetic circuit at the back of the diaphragm; and a housing supporting the loudspeaker unit at the periphery of the diaphragm and enclosing the loudspeaker unit with the exception of the front surface, the housing having an inner surface with irregularities thereon dimensioned and positioned to prevent the generation of standing sounding waves within the housing.

Upon driving a loudspeaker unit in the headphone device of the present invention, sound waves are radiated into the housing from the rear side of the loudspeaker unit and randomly reflected by irregularities formed on the inner surface of the housing so as to prevent the generation of standing waves. The irregularities formed on the inner surface of the housing also function to scatter the resonance points on the housing caused by vibrations transmitted to the housing upon driving the loudspeaker unit. The irregularities also function to augment the mechanical strength of the housing as well as to prevent the occurrence of warping or deformation.

The above, and other objects, features and advantages of the invention, will be apparent in the following detailed description of preferred embodiments of the invention when read in conjunction with the accompanying drawings in which corresponding components are identified by the same reference numerals.

DETAILED DESCRIPTION OF PREFERRED EMBODIMENTS

A headphone device according to a first embodiment of the present invention will now be described with reference to FIGS. 1–4.

Figure 1:
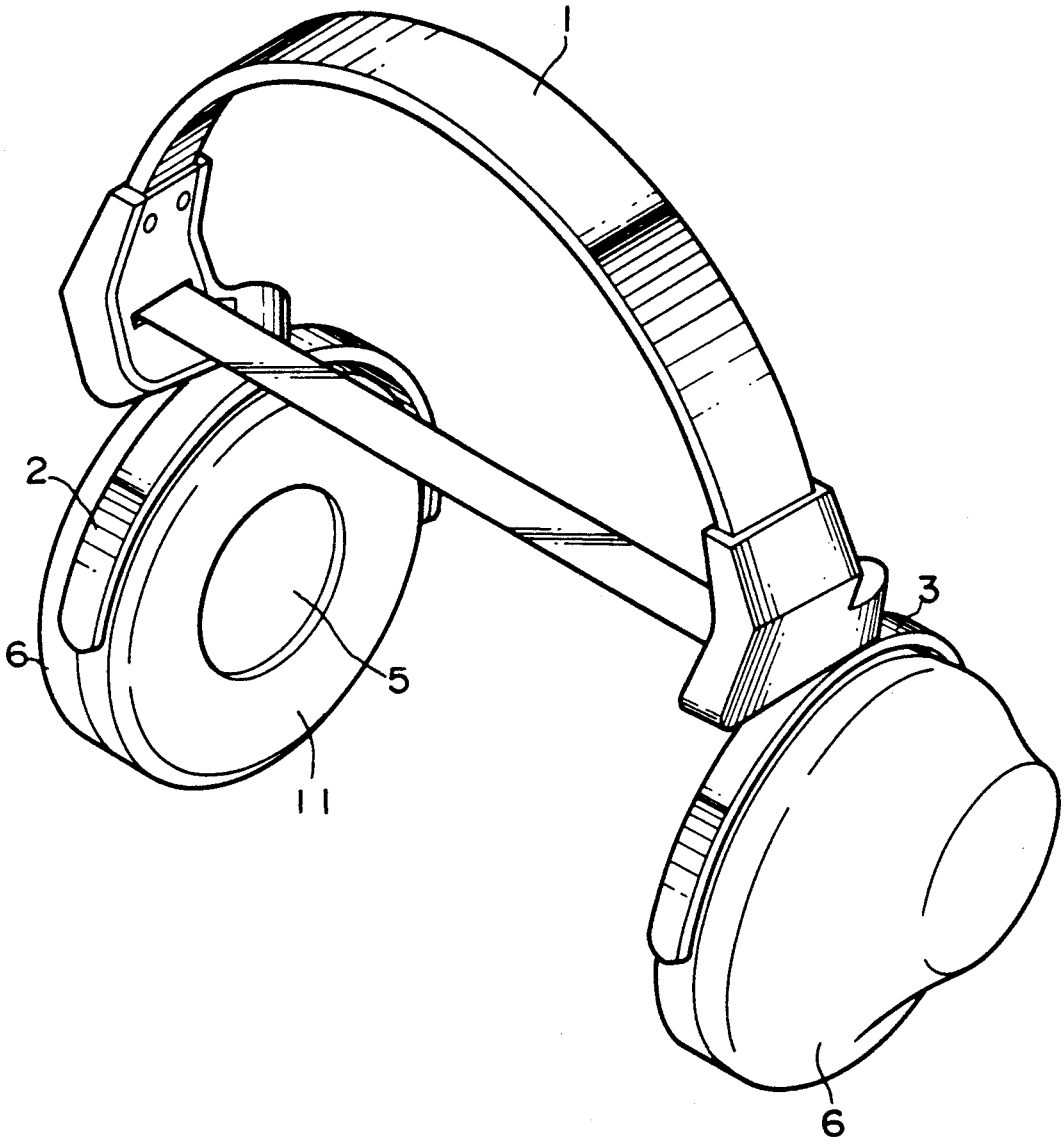
FIG. 1 is an overall perspective view of a headphone device according to an embodiment of the present invention.
Figure 2:
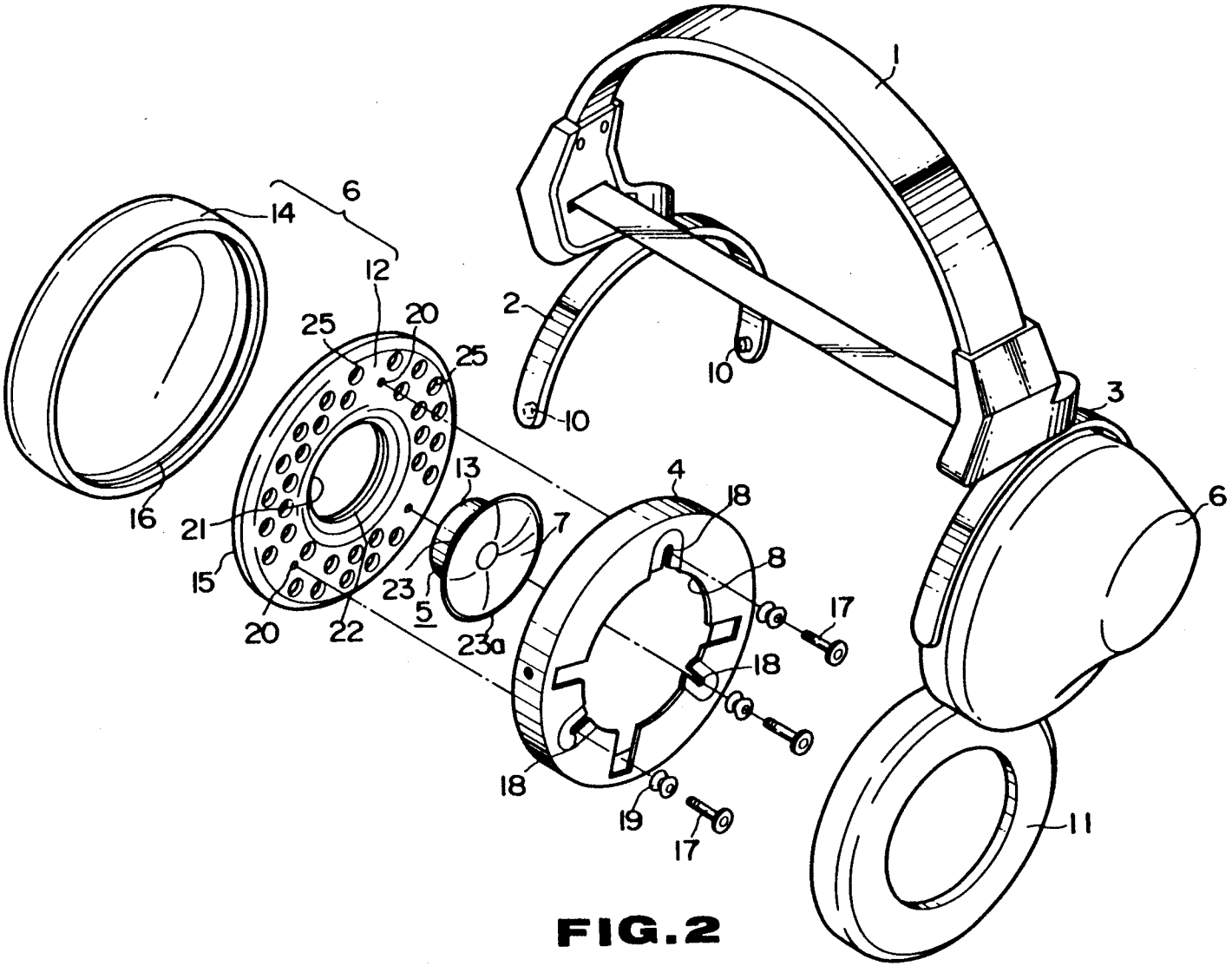
FIG. 2 is an exploded perspective view of the headphone device of FIG. 1.

As shown in FIGS. 1 and 2, a headband 1, formed from a resiliently deformable strap of laminated carbon fibers, has provided at both ends thereof hangers 2 and 3, formed from a relatively light metal such as a magnesium alloy or a synthetic resin and which function as loudspeaker supporting members. Housing supporting plates 4 are turnably supported by hangers 2 and 3. Housings 6, 6 contain left and right loudspeaker units 5, respectively, and are mounted to hangers 2 and 3 by means of the supporting plates 4. Each housing supporting plate 4 is basically formed as a disk having a central opening 8 for exposing the front surface of a loudspeaker unit 5 which includes a diaphragm 7. Each supporting plate 4 is turnably supported by either hanger 2 or 3 by pivot pins 10 located at the ends of each of the semi-arcuate hangers 2 and 3. An ear pad 11 is constructed of a resilient material and bonded, for example, with an adhesive, to the front side of the supporting plate 4 so as to function as the auricular abutting section thus, providing a positive contact and a comfortable feeling when attached to the user's head. The housing 6 is attached to the side of the supporting plate 4 opposite the side provided with the ear pad 11.

The housing 6 includes a front plate 12, to which the loudspeaker unit 5 is mounted, and a main body 14, which is contoured so as to enclose the back side of the loudspeaker unit 5 including a magnetic circuit 13. Each front plate 12 and main body 14 is machined from a plate-like block of pure natural wood, such as from the zelkova tree, to the desired shape. The front plate 12 is attached to the main body 14 by fitting an annular engaging portion 15, on the outer peripheral rim of the plate 12, into a mating step-like annular recess 16 on the inner peripheral surface of the opening side of the main body 14, and by bonding the two mating portions 15 and 16 together with, for example, an adhesive.

The front plate 12, of housing 6, is secured to the back side of the supporting plate 4 by a plurality of set screws 17. The housing supporting plate 4 includes cut-outs 18 for accomodating a number of buffer elements 19 which, for example, are constructed from rubber-buffer elements 19 function to interrupt the transmission of vibrations between the housing supporting plate 4 and the housing 6. Elements 19 further function to compensate for positional deviation between the cut-outs 18 in supporting plate 4 and screw holes 20 in the front plate 12 so as to insure positive thread engagement of the set screws 17.

The loudspeaker unit 5 is attached to the housing 6 by inserting the magnetic circuit 13 into the housing 6 through a loudspeaker mounting aperture 21, located at the center of the front plate 12, until an outer peripheral rim 23*a* of a flange 23 of unit 5 is engaged with an engaging step 22 on the rim of the loudspeaker mounting aperture 21. The mating engaging portions are then bonded together with, for example, an adhesive, as shown in FIG. 3.

Figure 3:
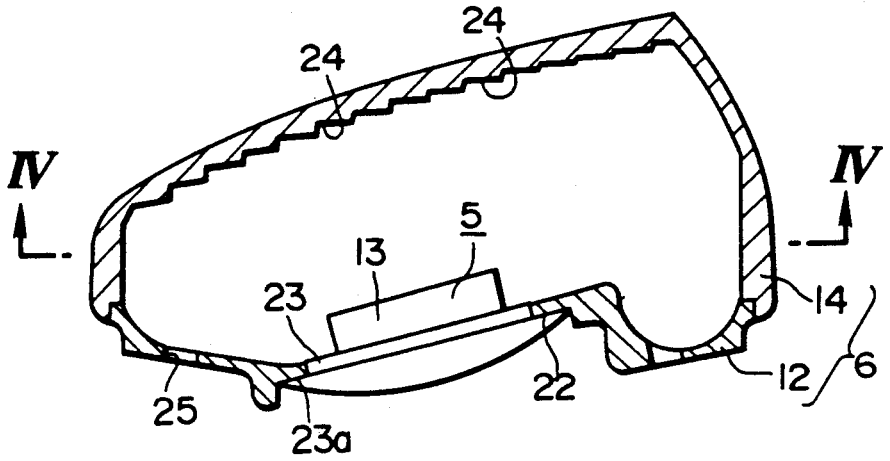
FIG. 3 is a longitudinal sectional view of the housing contained in the headphone device of FIG. 2.
Figure 4:
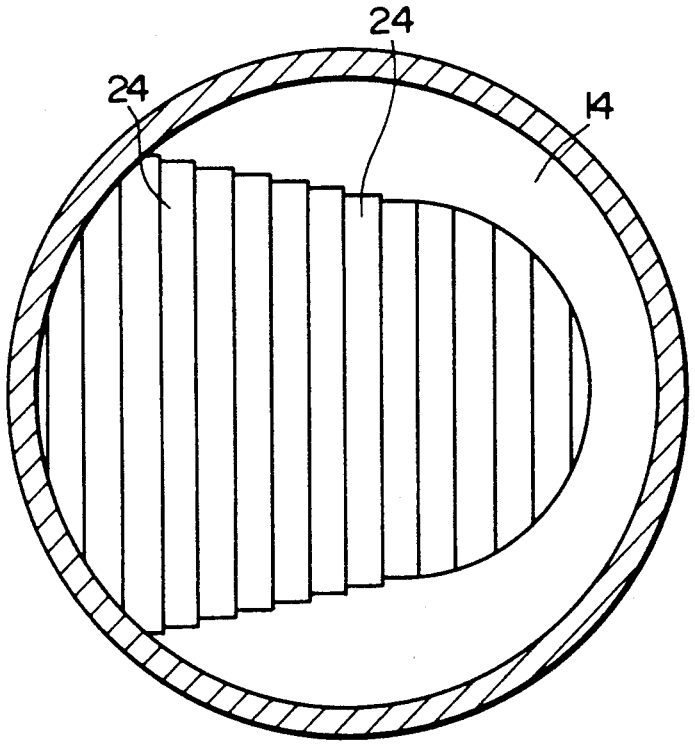
FIG. 4 is a sectional view taken along line IV—IV of FIG. 3.

On the inner side of the main body 14, which faces the rear side of the loudspeaker unit 5 are a plurality of inclined mutually parallel grooves 24, as shown in FIGS. 3 and 4. Grooves 24 have a serrated cross-sectional shape which resemble wind-wrought patterns in the sand when viewed from above. Grooves 24 have an angle of inclination such that none of the surfaces on the inner surface of the main body 14 are parallel to the plane of diaphragm 7 of the loudspeaker unit 5. The angle of inclination, along with the width and interval spacing of grooves 24, are such that a standing wave is not generated when a sound wave is radiated from the rear side of the loudspeaker unit 5 and reflected from the inner surface of the main body 14.

A large number of sound transmitting through-holes 25 are formed in the front plate 12.

Figure 5:
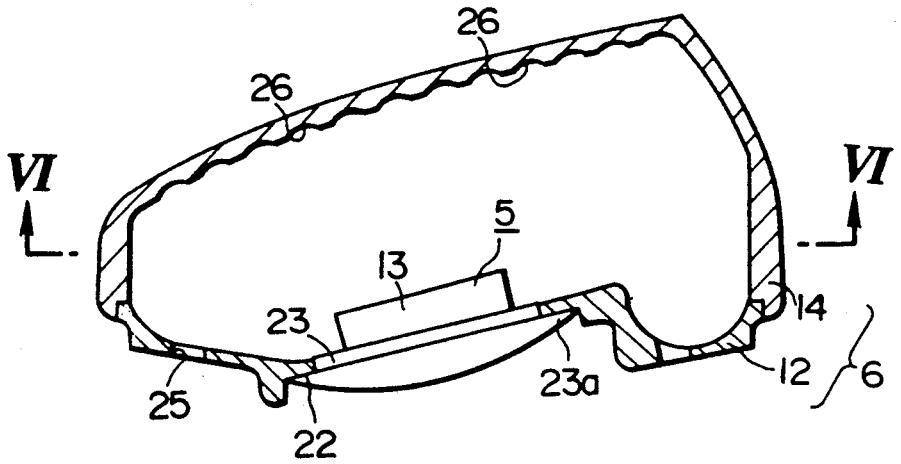
FIG. 5 is a longitudinal sectional view of the housing according to a second embodiment of the present invention.
Figure 6:
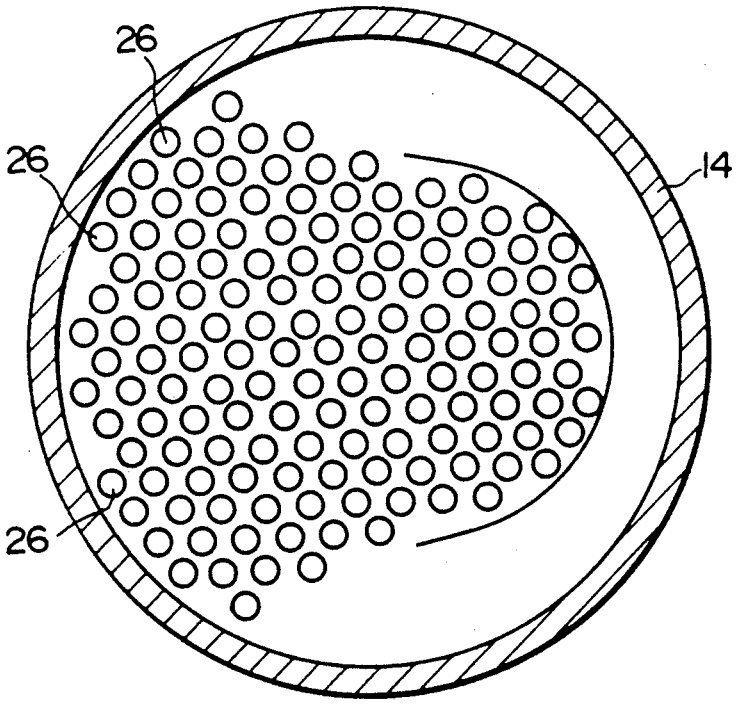
FIG. 6 is a sectional view taken along line VI—VI of FIG. 5.

The irregularities on the inner surface of the housing 6 are not limited to the juxtaposed grooves having a serrated cross-section as described hereinabove, but may also comprise a large number of columnar projections 26 as shown in FIGS. 5 and 6.

Figure 7:
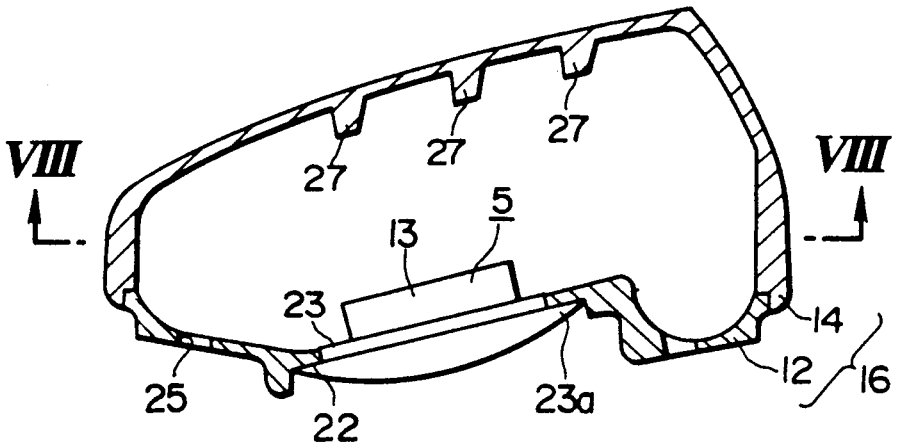
FIG. 7 is a longitudinal sectional view of the housing according to a third embodiment of the present invention.
Figure 8:
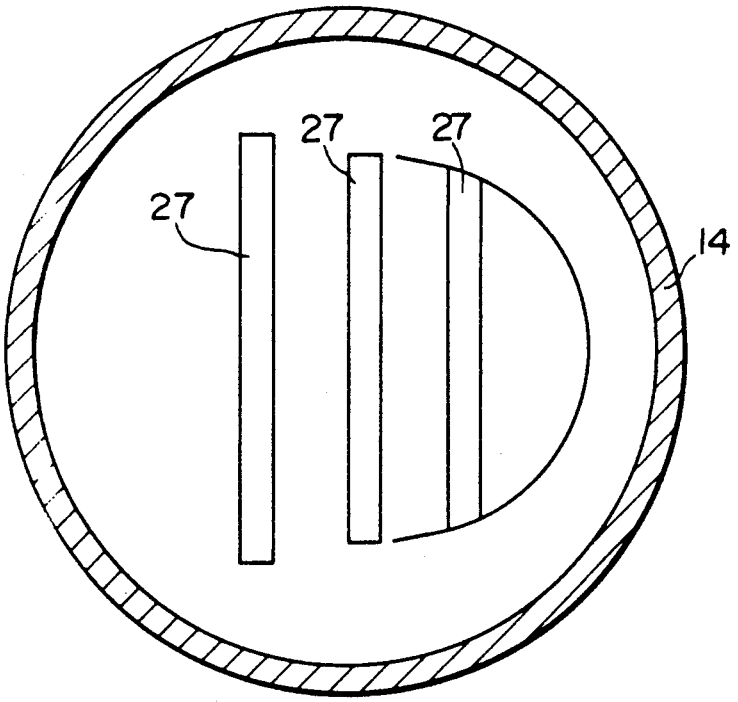
FIG. 8 is a sectional view taken along line VIII—VIII of FIG. 7.

The irregularities on the inner surface of the housing 6 may also comprise by several cross-pieces 27 which project from the inner surface of the main body 14, as shown in FIGS. 7 and 8. Although the cross-pieces 27 are shown as integrally formed with the main body 14, they may include separate elongated pieces having relatively small thicknesses, which are subsequently attached to the main body 14.

Although the irregularities have been hereinabove described as on the inner surface of the housing 6 which faces the rear side of the loudspeaker unit 5, they may also be located on other inner surfaces so as to take into account the acoustic characteristics of the device. The irregularities, or projections, on other portions also prevent warping or deformation which might occur when the housing 6 is constructed from natural wood.

Sound absorbing materials, such as wool or cotton, may be used within the interior of the housing 6.

A material having a relatively high Young's modulus and internal loss is preferred for housing 6. Although the housing 6, as hereinabove described, is machined from a block of pure natural wood from, for example, the zelkova tree, it may also be constructed of plywood or molded resin which have properties comparable with those of natural wood.

In the headphone device according to an embodiment of the present invention as described hereinabove, the inner surface of the housing which holds the loudspeaker unit contains irregularities, so that, even when the diaphragm of the loudspeaker unit is positioned so as to be parallel with the inner surface of the housing, the sound waves radiated from the rear side of the loudspeaker unit are randomly reflected by the irregularities so as to prevent the generation of standing waves. Thus the sound reproducing properties are prevented from being lowered.

The irregularities on the inner surface of the housing also act to scatter the resonance points caused by the vibration of the housing thus preventing the mechanical ringing of the housing which, in turn prevents the acoustic properties of the reproduced sound from being lowered.

Further, the irregularities act to prevent warping or deformation from occurring when the housing is constructed from a block of natural wood. Thus, natural wood can be utilized for the housing material, which is a preferred material because of its relatively high Young's modulus and relatively high internal losses, so as to result in a headphone device which exhibits optimum sound reproducing characteristics, improved durability and can be while the headphone easily produced.

What is claimed is:

1. A headphone device comprising:

a loudspeaker unit including a diaphragm having a front surface, a back surface, and a periphery, and a magnetic circuit at the back surface of said diaphragm; and a housing having a front plate supporting said loudspeaker unit at the periphery of said diaphragm, said housing enclosing said loudspeaker unit except for the front surface of the diaphragm thereof, said housing including means for preventing the generation of standing sound waves within said housing comprising an inner surface of said housing provided with irregularities thereon.

2. A headphone device according to claim 1; wherein said loudspeaker unit is supported in said housing so that said front surface of said diaphragm lies in a plane which is approximately parallel to said inner surface of said housing.

3. A headphone device according to claim 1; wherein said housing includes a main body portion affixed to said front plate and which includes said inner surface with said irregularities thereon.

4. A headphone device according to claim 1; wherein said irregularities are provided on at least a portion of said inner surface of said housing which faces said magnetic circuit.

5. A headphone device according to claim 4; wherein said irregularities include a plurality of grooves in the portion of said inner surface of said housing.

6. A headphone device according to claim 5; wherein said front surface of said diaphragm lies generally in a plane and in which said grooves have surfaces inclined at a predetermined angle so as to be non-parallel to said plane.

7. A headphone device according to claim 4; wherein said irregularities include projections on the portion of said inner surface of said housing.

8. A headphone device according to claim 4; wherein said irregularities include cross-pieces which project toward said magnetic circuit from the portion of said inner surface of said housing.

9. A headphone device comprising:

a pair of loudspeaker units each including a diaphragm having a front surface, a back surface and a periphery and a magnetic circuit at the back surface of said diaphragm;

a pair of housings each supporting a respective one of said loudspeaker units at the periphery of said diaphragm;

a pair of hangers each supporting a respective one of said housings; and a headband having opposite ends to which said hangers are respectively attached;

each of said housings including a front plate to which the respective loudspeaker unit is supported, and a main body portion of natural wood having an inner surface and enclosing said loudspeaker unit except for the front surface of the diaphragm thereof, said inner surface of said main body portion including means for preventing the generation of standing sound waves within said housing comprising a plurality of irregularities on said inner surface.

10. A headphone device according to claim 9; wherein said irregularities are provided on at least a portion of the inner surface of said main body portion which faces the magnetic circuit of said respective one of said loudspeaker units.

11. A headphone device according to claim 10; wherein said irregularities include a plurality of grooves in the portion of the inner surface of said main body portion.

12. A headphone device according to claim 11; wherein said front surface of the diaphragm of each of said pair of loudspeaker units lies generally in a respective plane and in which each of said plurality of grooves has a surface included at a predetermined respective angle so as to be non-parallel to said respective plane.

13. A headphone device according to claim 10; wherein said irregularities included projections provided on said portion of the inner surface of said main body portion.

14. A headphone device according to claim 10; wherein said irregularities include a plurality of cross-pieces provided on said portion of the inner surface of said main body portion.

* * * * *